United States Patent [19]

Öttle

[11] 4,160,010

[45] Jul. 3, 1979

[54] DEVICE FOR PURIFYING EXHAUST GASES

[75] Inventor: Walter Öttle, Faurndau, Fed. Rep. of Germany

[73] Assignee: J. Eberspächer, Fed. Rep. of Germany

[21] Appl. No.: 851,306

[22] Filed: Nov. 14, 1977

Related U.S. Application Data

[63] Continuation of Ser. No. 690,864, May 28, 1976, abandoned.

[51] Int. Cl.[2] ..... B01J 35/04; B01J 8/02; B01J 3/15

[52] U.S. Cl. ..... 422/180; 60/299

[58] Field of Search ..... 23/288 FB, 288 FC; 60/299, 301

[56] References Cited

U.S. PATENT DOCUMENTS

| | | | |
|---|---|---|---|
| 3,692,497 | 9/1972 | Keith et al. | 23/288 FC |
| 3,854,888 | 12/1974 | Frietzsche et al. | 23/288 FC |
| 3,892,537 | 7/1975 | Gulati et al. | 23/288 FC |
| 3,972,687 | 8/1976 | Frietzsche | 23/288 FC |
| 3,978,567 | 9/1976 | Vroman | 23/288 FC |
| 3,984,207 | 10/1976 | Abthoff et al. | 23/288 FC |

FOREIGN PATENT DOCUMENTS

| | | | |
|---|---|---|---|
| 2211522 | 9/1973 | Fed. Rep. of Germany | 23/288 FC |
| 2213539 | 10/1973 | Fed. Rep. of Germany | 23/288 FC |
| 2222663 | 12/1973 | Fed. Rep. of Germany | 23/288 FC |

*Primary Examiner*—Michael S. Marcus
*Attorney, Agent, or Firm*—McGlew and Tuttle

[57] ABSTRACT

A device for purifying exhaust gases of an internal combustion engine comprises a tubular housing with an exhaust gas inlet at one end and an exhaust gas discharge at the opposite end, and with a catalyst carrier disposed in the housing between the inlet and the discharge, which has a plurality of axially extending gas passages with a catalyst therein for the passage of exhaust gases therethrough, for the purification thereof. A ring is disposed in the tubular housing adjacent each end of the catalyst carrier and it has an interior diameter which is less than the outer diameter of the catalyst so that the gases are deflected inwardly around the ring. To ensure that the gases do not pass over the periphery of the catalyst carrier into an insulation space and without passing through the catalyst containing passages, a foil sheet is provided which extends over the periphery of the catalyst carrier and is secured to and sealed with the ring. The securement may take place between a small diameter portion of the outer housing and the ring, or between the outer edge of an angle shaped ring and the foil sheet. The foil sheet may extend inwardly from each end and overlap in the center or be extended only a few inches over each end of the catalyst carrier so as to ensure the correct flow of the exhaust gases.

12 Claims, 4 Drawing Figures

DEVICE FOR PURIFYING EXHAUST GASES

This is a continuation of application Ser. No. 690,864 filed May 28, 1976, now abandoned.

FIELD AND BACKGROUND OF THE INVENTION

This invention relates in general to the construction of devices for purifying exhaust gases, and in particular to a new and useful device having a catalyst carrier with a plurality of axially extending passages therein, through which the exhaust gases flow, and which is sealed to the housing by foil sheets at each end, so as to ensure that the flow will not be around the periphery of the carrier, and through the insulation space.

DESCRIPTION OF THE PRIOR ART

With the known catalytic detoxication devices, particular difficulties have resulted from the fact that the catalyst carrier, or the so-called catalytic honeycomb body, is very sensitive to compressive loads. Further difficulties are due to the fact that the exhaust gases have to be cleaned as completely as possible, and consequently must be directed through the body of the catalyzer. Since a thermal insulation is usually provided between the catalytic body and the housing, the risk is run that at least a part of the exhaust gases will flow around the catalyzer body and find some way through the thermal insulation and consequently leave the device without being purified. It becomes imperative in the design of such devices, therefore, to ensure that there are suitable mountings for the catalytic honeycomb body. Great care must be taken to ensure that there is no destruction of this body due to thermal expansions and contractions. The known constructions have the disadvantage that they are very expensive.

SUMMARY OF THE INVENTION

In accordance with the present invention, there is provided a device for purifying exhaust gases, which includes a temperature resistant ring arranged at each end of the catalyst body for facilitating its axial alignment within a housing, and which also includes a foil sheet which is connected to the ring, and sealed with it at its one end, and extends around the end and over the periphery of the catalyst body, so as to deflect all gases away from an insulation space between the body and the housing wall to the individual passage as defined through the catalyst body.

In accordance with one embodiment of the invention, the housing is made with an intermediate annular tubular wall, having a central portion of increased diameter and doubled ends at each end, which are connected to a transition piece of an exhaust pipe connection, and to an exhaust gas discharge. The connection between the housing ends and the transition pieces is through a flange. Foil sheets are engaged over the periphery of the catalyst body and they extend axially outwardly from each end thereof and are sealed between the flanges of the housing and the transition piece and also with the periphery of a ring interposed between the transition piece and the end of the catalyst body.

In another embodiment of the invention, the ring comprises an angle member which is secured at its one face peripherally outwardly to the connection between the transition piece and the housing, and the opposite angle edge is secured to one end of the foil sheet. The foil sheet is this embodiment extends radially and axially inwardly from the connection to the angle member, and over the periphery of the catalyst body. In each embodiment the foil sheets may be arranged so that they overlap centrally within the insulation space defined between the catalyst body and the outer housing wall, or they may be discontinued intermediate the length of the catalyst body. This latter embodiment is particularly inexpensive inasmuch as it requires only a short length of foil sheet in order adequately to ensure that the exhaust gases do not flow through the insulation space.

Accordingly it is an object of the invention to provide a device for purifying exhaust gases which includes a foil sheet arranged at each end of a catalyst body through which the exhaust gases are passed, and which are sealed to each end of the housing together with a sealing ring so as to ensure that the gases flow through the passages of the catalyst body and not through an insulation space defined between the body and the outer wall.

A further object of the invention is to provide a device for purifying exhaust gases which is simple in design, rugged in construction and economical to manufacture.

For an understanding of the principles of the invention, reference is made to the following description of typical embodiments thereof as illustrated in the accompanying drawings.

DESCRIPTION OF THE PREFERRED EMBODIMENT

Figure 1:
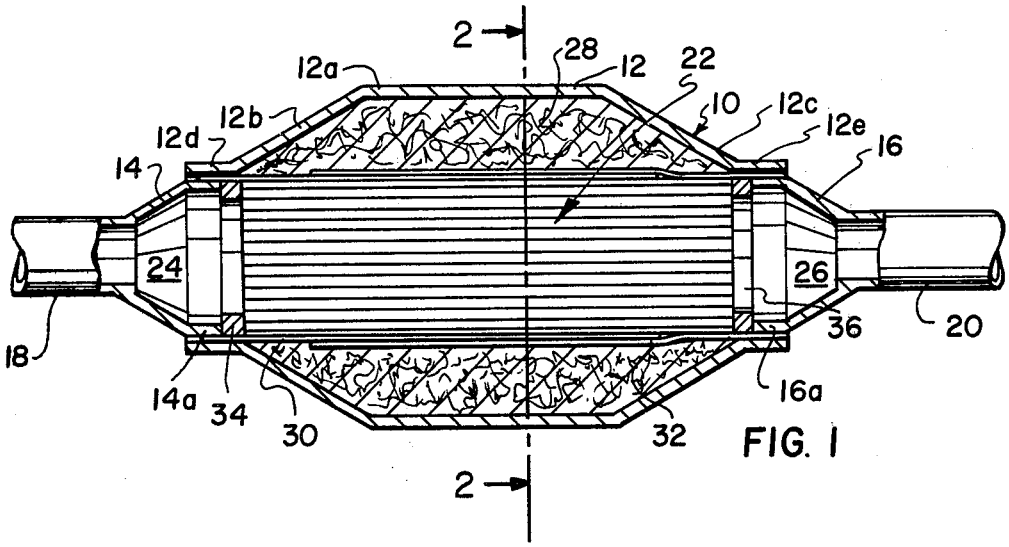
FIG. 1 is an axial sectional view of a device for purifying exhaust gases constructed in accordance with the invention.
Figure 2:
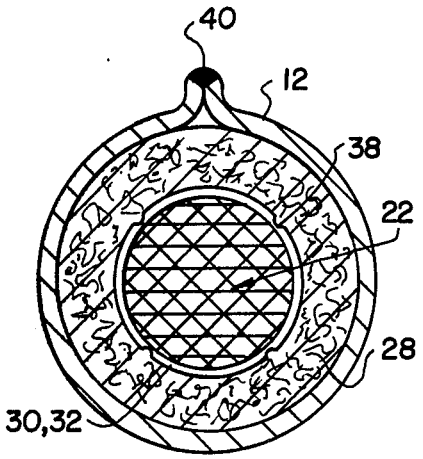
FIG. 2 is a sectional view taken along the line 2—2 of FIG. 1.

Referring to the drawings in particular, the invention embodied therein in FIGS. 1 and 2 comprises an exhaust gas purifying device generally designated 10, which includes a housing comprising a tubular outer wall 12, having a central large diameter portion **12*a*, an inwardly bevelled portion 12*b* and 12*c* at each end, and a flange portion 12*d* and 12*e* at each end which extends axially. Flange portion 12*d* and 12*e* is joined to a flange portion 14*a* and 16*a* respectively of transition pieces 14 and 16 of an exhaust gas supply pipe 18 and an exhaust gas discharge pipe 20** respectively.

In accordance with the invention, a catalyst carrier generally designated 22 is disposed in the housing between an inlet 24 and a discharge 26, and its periphery is spaced inwardly from the outer wall to define an insulation space 28 therebetween which is in the embodiment illustrated is filled with a compacted insulation material 28, which aids in the positioning of the catalyst carrier 22.

In accordance with the invention, in order to ensure that the exhaust gases flow through axially extending catalyst filled passages which are defined in the catalyst body 22, rather than around the periphery thereof and into the insulation space 28, each end of the body 22 is covered by a foil sheet 30, 32 and, in the embodiment illustrated, these sheets are overlapped centrally over the catalyst body periphery. At their outer opposite ends, the foil sheets are secured between flanges 12*d* and 14*a* and 12*e* and 16*a*, and they are also secured to a ring 34, 36, which is arranged to abut against the edge of the catalyst carrier 22 and aid in its axial retention. Notches 38 are advantageously formed inwardly in the foil sheets 30 and 32 which may be of sheet metal, in order to ensure that there will be no relative rotational displacement between the catalyst body 22 and the sheets.

In the embodiment of FIGS. 1 and 2, the outer housing 12 is advantageously made of a sheet which is formed into a tube and joined together such as by welding at 40 as indicated in FIG. 2.

Figure 3:
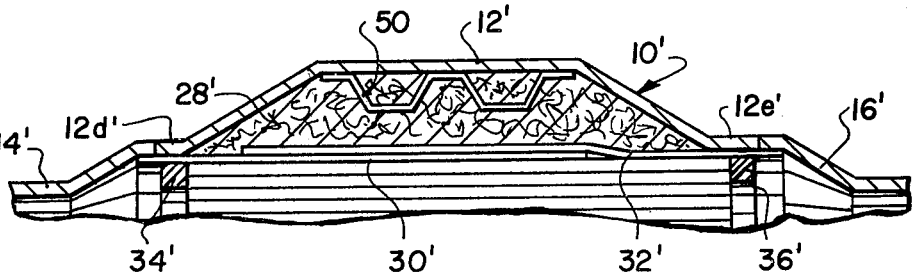
FIG. 3 is a partial view similar to FIG. 1 of another embodiment of the invention.

FIG. 3 is very similar to FIG. 1, but comprises a housing 10' having transition pieces 14' and 16' formed therein at the respective ends. In addition the housing is reinforced by a corrugated reinforcing inner tube 50. In this embodiment, rings 34' and 36' are secured at their outer periphery to respective foil sheets 30' and 32', and to flange portions 12*d* and 12*e'* respectively, at the corresponding ends of the housing 12'.

Figure 4:
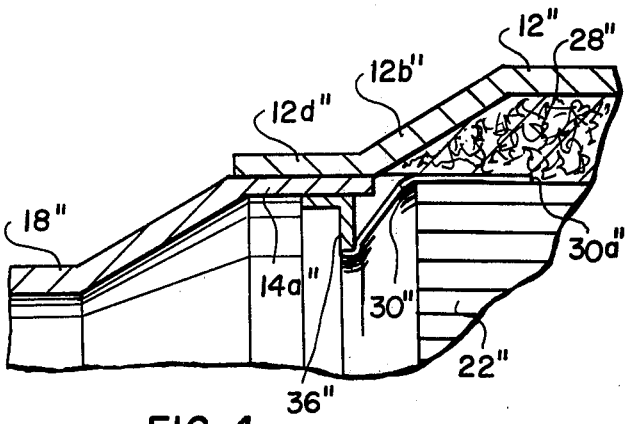
FIG. 4 is a partial view similar to FIG. 1 of still another embodiment of the invention.

In the embodiment of FIG. 4, housing 12'' includes bevelled portions 12*b''* and 12*c''* at each end as in FIG. 1, with corresponding flange portions 12*d''* and 12*e''* which are secured to flange portions 14*a''* and 16*a''* respectively. In this embodiment however a ring 36'' of angle shaped configuration is arranged at each end and includes one angle part secured directly to flanges 14*a''* and 12*d''* such as by brazing, and the opposite outer edge of the other angle part is secured to a foil sheet 30'' which advantageously comprises a sheet metal which extends radially inwardly from the outer edge of the angle ring 36'' obliquely to the outer periphery of catalyst carrier 22''. In this embodiment the foil sheet 30'' has an end 30*a''* which ends intermediate the length of the catalyst carrier 22'' and does not overlap with the sheet 32'' of the opposite end, as in the embodiment of FIG. 1.

While specific embodiment of the invention have been shown and described in detail to illustrate the application of the principles of the invention, it will be understood that the invention may be embodied otherwise without departing from such principles.

What is claimed is:

1. A device for purifying exhaust gases in an internal combustion engine, comprising a tubular housing having an outer wall with a first end having an inlet for exhaust gases and an opposite second end having an exhaust gas discharge, a catalyst carrier disposed in said housing and having a plurality of axially extending catalyst containing gas passages extending therethrough defining individual catalyst gas flow passages from said inlet to said outlet, said catalyst carrier having an end wall at each end and a side peripheral wall, first and second foil sheets, each having inner portions covering a portion of said catalyst carrier and outer portions extending beyond the respective end of the catalyst carrier, ring means securing the outer ends of each first or second sheet to the interior of said housing beyond the respective end of the catalyst carrier, said sheets extending over said peripheral wall by an amount sufficient to prevent gases from flowing into the space around said peripheral side wall of said carrier and said tubular housing, said side periphery of said catalyst carrier with the portions of the first and second sheets thereon being spaced inwardly from said outer wall of said tubular housing to define an insulation space therebetween, and a compacted insulation material disposed in said insulation around the periphery of said carrier and bearing against said foil sheets and said carrier to hold said carrier in position in said housing.

2. A device according to claim 1, including an exhaust gas connection including a transition part having a flange, said outer wall of said tubular housing having a flange part overlapping the flange part of said exhaust connection and having an opposite discharge end with a discharge flange portion, a discharge connection including a transition piece having a flange engaged within the discharge flange portion of said outer wall of said tubular housing.

3. A device according to claim 1, wherein said first sheets outer end portions engage between said exhaust gas connection transition piece flange and said outer wall of said tubular housing and the discharge end flange and the flange of said discharge connection.

4. A device for purifying exhaust gases of an internal combustion engine, comprising a tubular housing having an outer wall with a first end having an inlet for exhaust gases and an opposite second end having an exhaust gas discharge, a catalyst carrier disposed in said housing and having a plurality of axially extending catalyst containing gas passages extending therethrough defining individual catalyst gas flow passages from said inlet to aid outlet, a ring disposed in said housing adjacent each end of said catalyst carrier having an interior diameter less than the outer diameter of said catalyst carrier and being secured at its periphery to said housing, and a foil sheet adjacent each end of said carrier having one end connected to and sealed with said ring and extending from said ring around each respective end and over at least a portion of the periphery of said catalyst carrier, the portion of said foil sheet overlying said catalyst carrier being spaced from the interior of said housing outer wall and defining an insulating space therebetween, and insulation material filling said insulation space and flaring against and pressing said sheets against said carrier.

5. A device for purifying exhaust gases in an internal combustion engine, comprising a tubular housing having an outer wall with a first end having an inlet for exhaust gases and an opposite second end having an exhaust gas discharge, a catalyst carrier disposed in said housing and having an end wall at each end and a side wall between said end walls, a plurality of axially extending catalyst containing gas passages extending therethrough defining individual catalyst gas flow passages from said inlet to said outlet, two foil sheets having inner ends which overlap over and cover the periphery of said catalyst carrier side wall and outer ends which extend axially beyond and without covering the respective ends of said catalyst carrier and secured to the interior of said housing, only the portions of said foil sheets which overlie said catalyst carrier being spaced from the interior of said housing radially inwardly so as to define an insulating space therebetween, and a compacted insulation material disposed in said insulating space around the periphery of said carrier and bearing against said foil sheets and said carrier to hold said carrier in position in said housing.

6. A device according to claim 5, wherein said tubular housing includes a flange at each end, an exhaust pipe connection adjacent one end having a transition piece with a flange in juxtaposition with the flange of said housing, the opposite end of said housing having a discharge pipe with a transition piece having a flange in juxtaposition with the flange at this end of said housing.

7. A device according to claim 5, wherein each of said foil sheets have an inwardly extending crimped portion engaged into the periphery of said carrier for ensuring against angular rotation of said sheets in respect to said carrier.

8. A device for purifying exhaust gases in an internal combustion engine, comprising a tubular housing having an outer wall with a first end having an inlet for exhaust gases and an opposite second end having an exhaust gas discharge, a catalyst carrier disposed in said housing and having an end wall at each end and a side wall between said end walls, a plurality of axially extending catalyst containing gas passages therethrough defining individual catalyst gas flow passages from said inlet to said outlet, two foil sheets having inner ends which overlap over and cover the periphery of said catalyst carrier side wall and outer ends which extend axially beyond and without covering the respective ends of said catalyst carrier and secured to the interior of said housing, only the portions of said foil sheets which overlie said catalyst carrier being spaced from the interior of said housing radially inwardly so as to define an insulating space therebetween, a compacted insulation material disposed in said insulating space around the periphery of said carrier and bearing against said foil sheets and said carrier to hold said carrier in position in said housing, said foil sheets having overlapping portions adjacent their inner ends over said catalyst carrier, and a corrugated tube positioned in the insulating space bearing against said compacted insulation material.

9. A device for purifying exhaust gases in an internal combustion engine, comprising a tubular housing having an outer wall with a first end having an inlet for exhaust gases and an opposite second end having an exhaust gas discharge, a catalyst carrier disposed in said housing and having an end wall at each end and a side wall between said end walls, a plurality of axially extending catalyst containing gas passages extending therethrough defining individual catalyst gas flow passages from said inlet to said outlet, two foil sheets having inner ends which overlap over and cover said catalyst carrier side wall and outer ends which extend axially beyond and without covering the respective ends of said catalyst carrier and secured to the interior of said housing, only the portions of said foil sheets which overlie said catalyst carrier being spaced from the interior of said housing radially inwardly so as to define an insulating space therebetween, and a compacted insulation material disposed in said insulating space around the periphery of said carrier and bearing against said foil sheets and said carrier to hold said carrier in position in said housing, and a ring at each end of said catalyst carrier bearing radially outwardly against the associated end of a respective foil sheet.

10. A device for purifying exhaust gases in an internal combustion engine, comprising a tubular housing having an outer wall with a first end having an inlet for exhaust gases and an opposite second end having an exhaust gas discharge, a catalyst carrier disposed in said housing and having an end wall at each end and a side wall between said end walls, a plurality of axially extending catalyst containing gas passages extending therethrough defining individual catalyst gas flow passages from said inlet to said outlet, two foil sheets having inner ends which overlap over and cover said catalyst carrier side wall and outer ends which extend axially beyond and without covering the respective ends of said catalyst carrier and secured to the interior of said housing, only the portions of said foil sheets which overlie said catalyst carrier being spaced from the interior of said housing radially inwardly so as to define an insulating space therebetween, and a compacted insulation material disposed in said insulating space around the periphery of said carrier and bearing against said foil sheets and said carrier to hold said carrier in position in said housing, said tubular housing including a flange at each end, said outer ends of said foil sheets being disposed in abutting engagement with said tubular housing flange at each end, an exhaust pipe connection adjacent one end having a transition piece with a flange in juxtaposition with the flange of said housing, the opposite end of said housing having a discharge pipe with a transition piece having a flange in juxtaposition with the flange at this end of said housing.

11. A device for purifying exhaust gases in an internal combustion engine, comprising a tubular housing having an outer wall with a first end having an inlet for exhaust gases and an opposite second end having an exhaust gas discharge, a catalyst carrier disposed in said housing and having an end wall at each end and a side wall between said end walls, a plurality of axially extending catalyst containing gas passages extending therethrough defining individual catalyst gas flow passages from said inlet to said outlet, two foil sheets having inner ends which overlap over and cover said catalyst carrier side wall and outer ends which extend axially beyond and without covering the respective ends of said catalyst carrier and secured to the interior of said housing, only the portions of said foil sheets which overlie said catalyst carrier being spaced from the interior of said housing radially inwardly so as to define an insulating space therebetween, and a compacted insulation material disposed in said insulating space around the periphery of said carrier and bearing against said foil sheets and said carrier to hold said carrier in position in said housing, including a reinforcement member disposed in said insulating space between said carrier and said outer wall of said housing.

12. A device for purifying exhaust gases in an internal combustion engine, comprising a tubular housing having an outer wall with a first end having an inlet for exhaust gases with a flange portion and an opposite second end having an exhaust gas discharge with a flange portion, a catalyst carrier disposed in said housing and having a plurality of axially extending catalyst containing gas passages extending therethrough defining individual catalyst gas flow passages from said inlet to said outlet, said catalyst carrier having an end wall at each end and a side peripheral wall, first and second foil sheets, each having inner portions covering a portion of said catalyst carrier and outer portions extending beyond the respective end of the catalyst carrier, means securing the outer ends of each first or second sheet to the interior of said housing beyond the respective end of the catalyst carrier, said sheets extending over said side peripheral wall by an amount sufficient to prevent gases from flowing into the space around said peripheral side wall of said carrier and said tubular housing, said side periphery of said catalyst carrier with the portions of the first and second sheets thereon being spaced inwardly from said outer wall of said tubular housing to define an insulation space therebetween, and a compacted insulation material disposed in said insulation around the periphery of said carrier and bearing against said foil sheets and said carrier to hold said carrier in position in said housing, and a flange ring disposed within said flange portion of each of said exhaust gas inlet connection and said discharge connection and having first flat angle portion abutting against said flange portion and a second angle portion extending radially inwardly, each of said first and second sheets extending over respective radially inwardly extending ends of said ring and secured thereto.

* * * * *